US006918493B2

(12) United States Patent
Hinzpeter et al.

(10) Patent No.: US 6,918,493 B2
(45) Date of Patent: Jul. 19, 2005

(54) APPARATUS FOR SINGLING OUT TABLETS IN A ROTARY TABLET-COMPRESSING PRESS

(75) Inventors: Jürgen Hinzpeter, Schwarzenbek (DE); Ingo Schmidt, Schwarzenbek (DE); Ulrich Gathmann, Hamburg (DE); Peter Preuss, Molln (DE); Werner Seifert, Wentorf (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 315 days.

(21) Appl. No.: 10/090,195

(22) Filed: Mar. 4, 2002

(65) Prior Publication Data

US 2002/0134713 A1 Sep. 26, 2002

(30) Foreign Application Priority Data

Mar. 20, 2001 (DE) ..... 101 13 414

(51) Int. Cl.[7] ..... B07C 5/00
(52) U.S. Cl. ..... 209/644; 209/559; 209/932
(58) Field of Search ..... 209/552, 644, 209/559, 432, 419

(56) References Cited

FOREIGN PATENT DOCUMENTS

| | | |
|---|---|---|
| DE | 25 12 262 | 10/1975 |
| DE | 36 39918 A1 | 10/1987 |

*Primary Examiner*—Donald P. Walsh
*Assistant Examiner*—Kaitlin Joerger
(74) *Attorney, Agent, or Firm*—Vidas, Arrett & Steinkraus, P.A.

(57) ABSTRACT

An apparatus for singling out tablets for a rotary tablet-compressing press the rotor of which has associated therewith a nozzle which, via a line and a controllable valve disposed in the line, is adapted to be connected to a pressure source in order to route a tablet into a rejects duct wherein the control signals for the valve are produced by a control device, characterized in that the line, between the orifice of the nozzle and the valve, has disposed a pressure sensor which delivers a sensor signal if the valve is opened or a predetermined minimum pressure prevails in the line and a logic evaluation circuit is provided into which the sensor signal and the control signal are input and that an error signal is produced in the evaluation circuit, which signal is evaluated by the control device if the time relation of the control signals and the sensor signals deviates from a predetermined relation.

3 Claims, 2 Drawing Sheets

APPARATUS FOR SINGLING OUT TABLETS IN A ROTARY TABLET-COMPRESSING PRESS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

It is known to provide compression force monitoring in rotary tablet-compressing presses and to detect and single out faulty tablets depending on such monitoring. WOPCT/US86/0058 is an example of singling out and is incorporated by reference into this application in its entirety. They are singled out depending on a ram-related fault via an appropriate singling-out deflector at the table outlet. The table outlet is divided into a go-duct for faultless tablets and a rejects duct for faulty tablets.

Two techniques are known to provide a single-out process. One uses a mechanical singling-out deflector which has a deflection plate which is operated electromechanically. A pneumatic mechanical singling-out deflector diverts the faulty tablet into a rejects duct by means of a jet of compressed air. The jet of compressed air is produced by a nozzle connectable to a source of compressed air with a controllable valve being arranged in the line leading to the nozzle.

It is desirable to monitor the singling-out of tablets as well. It is known for the mechanical singling-out deflector to detect the position of the deflector plate and to provide an appropriate feedback signal to the machine computer. A monitoring of operation has not become known hitherto for pneumatic singling-out deflectors.

It is the object of the invention to create a apparatus for pneumatically singling out tablets in a rotary tablet-compressing press which provides a means for monitoring its operation.

BRIEF SUMMARY OF THE INVENTION

In the inventive apparatus, a pressure sensor is arranged in the line between the valve and the nozzle orifice which delivers a sensor signal if the valve is opened or a predetermined minimum pressure prevails in the line. If there is a sufficiently high pressure and if the valve is opened a predetermined pressure will also prevail in the line leading to the nozzle and will cause the tablet to be diverted towards the rejects duct. Further, a logic evaluation circuit is provided which receives the sensor signal and the control signal for the valve. An error signal is produced if the time relation of the control signal and the sensor signal deviates from a predetermined relation.

If the machine computer produces a control signal for the valve which depends on a ram-related fault the valve will open and compressed air will flow to the nozzle. The sensor responds to the increase in pressure at a certain time lag and produces a sensor signal. If the driving of the valve, which is normally effected only in the form of a pulse, is terminated the pressure will also drop in the line. This drop of pressure is detected by the sensor. Since it takes some time for the sensor to establish the drop of pressure and to be switched over accordingly the sensor signal will change only after a certain period of time following the termination of the control signal. If the control signal is produced and no sensor signal is found to appear this suggests that the valve has not been opened or the pressure source does not produce any pressure. Thus, a faulty singling-out has been made. If the sensor signal continues to exist after the control signal is terminated this will also suggest a fault to the effect that the valve has not been properly closed. However, the above mentioned change-back time of the sensor needs to be considered here. Not until the sensor keeps up the sensor signal, upon termination of the control signal, for more time than the predetermined one conclusions can be drawn that there is a fault.

The inventive apparatus requires little expenditure for equipment. It merely requires a pressure sensor which is disposed in the line leading to the nozzle, and a control logic. The remaining provisions may be realized by software in the machine computer.

Another advantage of the invention also lies in the fact that it may be readily employed also for rotary tablet-compressing presses which previously have worked with a mechanical singling-out deflector.

BRIEF DESCRIPTION OF THE SEVERAL VIEWS OF THE DRAWINGS

The invention will now be explained in greater detail with reference to an embodiment illustrated in the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limited the invention to the particular embodiment illustrated.

Figure 1:
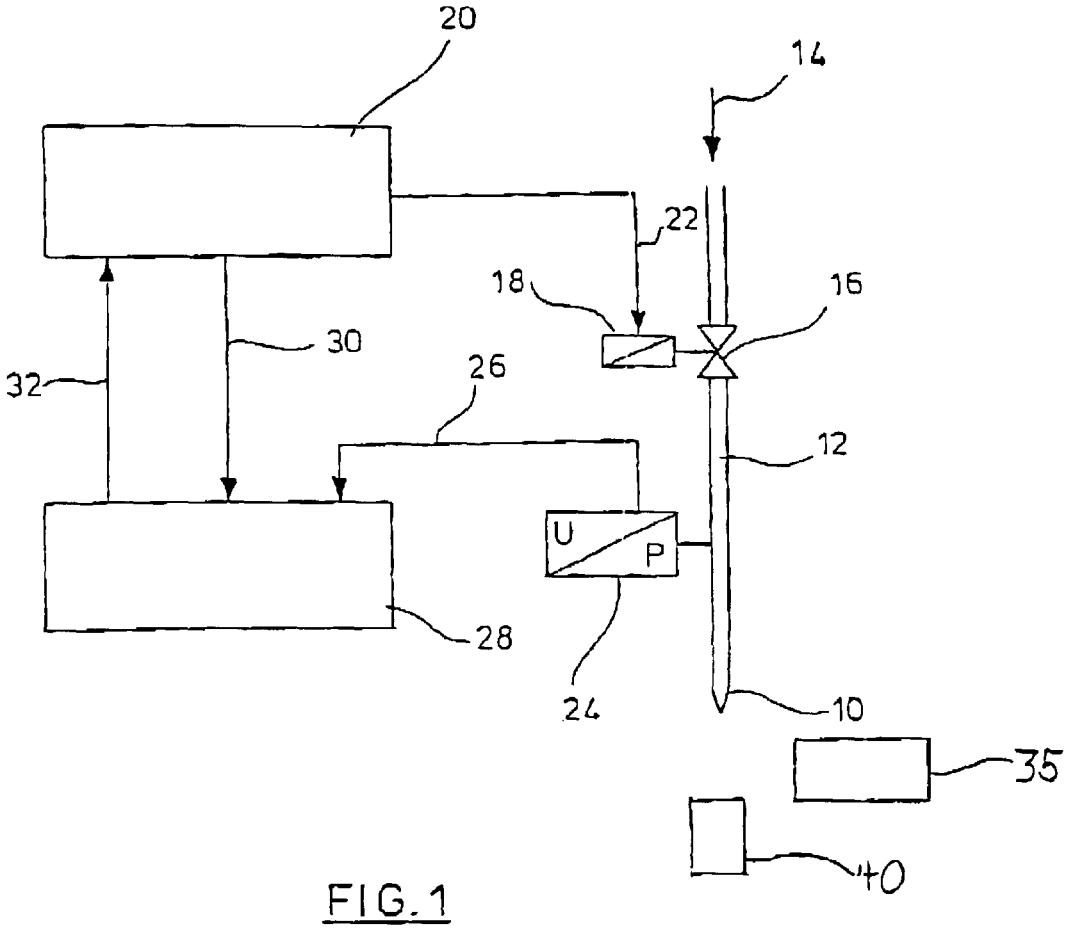
FIG. 1 shows an apparatus according to the invention in an extremely schematic way.

The rotary tablet-compressing press is not shown in the description of the inventive device. It is generally known in regard to its structure and function. Referring to FIG. 1, a nozzle 10 can be seen which is placed at a point on the rotor of the tablet-compressing press in a way that it can expel an air jet to divert a tablet ejected by the lower ram into a rejects duct, which has been known per se. The nozzle 10 is connected to a line 12 leading to a pressure source as is indicated by an arrow 14. The line 12 has seated therein a controllable air-operated valve 16 which is actuated by an electromagnet 18. Upon detection of faulty tablets, a machine computer 20 as is also known per se for controlling and monitoring such a rotary tablet-compressing press and the operation of which will not be depicted in detail produces a control signal for the valve 16 via a control line 22 depending on whether faulty tablets are detected. It is understood that the control instruction is produced to open the valve 16 so that the air jet which is then produced through the nozzle 10 diverts the tablet into the rejects duct 40 at the right moment. If the tablets are not faulty, the tablets continue into the go-duct 35.

Downstream of the valve 16, the line 12 has associated therewith a pressure sensor 24 which ascertains whether an increase in pressure takes place when the valve 16 is open.

The output signal of the sensor 24 is provided through a line 26 and to a control logic 28 which also receives the drive signal for the electromagnet 18 and the valve 16 via the control line 30. An error signal passes to the machine computer 20 through a control line 32. It is understood that the control logic 28 constitutes a module which is comprised of discrete semiconductor devices and, accordingly, processes the signals for the valve and the one from the pressure sensor.

Figure 2A:
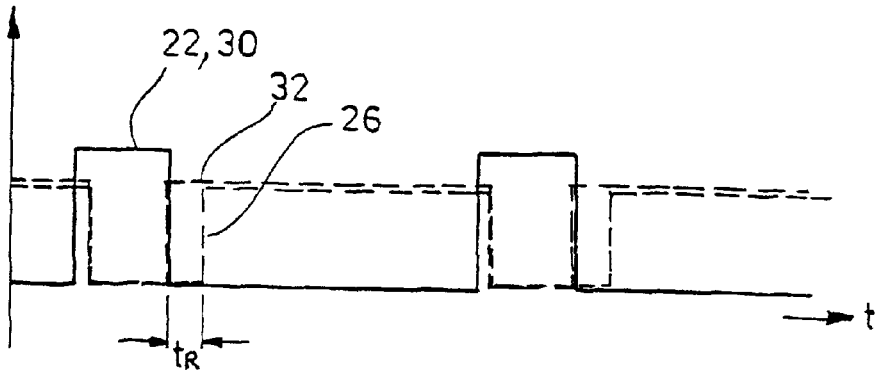
FIG. 2 shows the course of the signal during the operation of the apparatus of FIG. 1 in three plots.
Figure 2B:
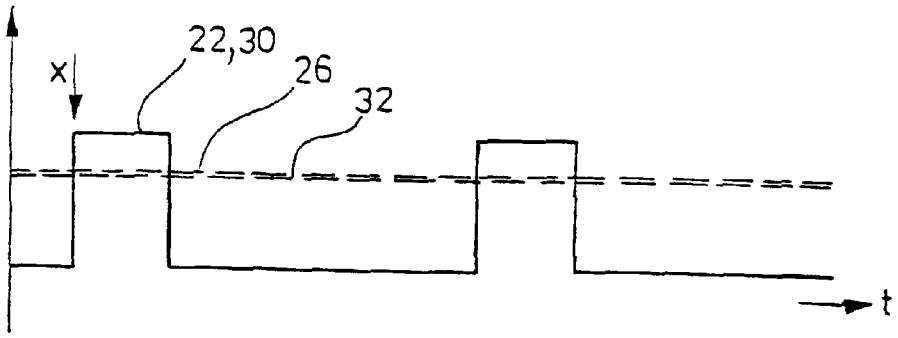
Figure 2C:
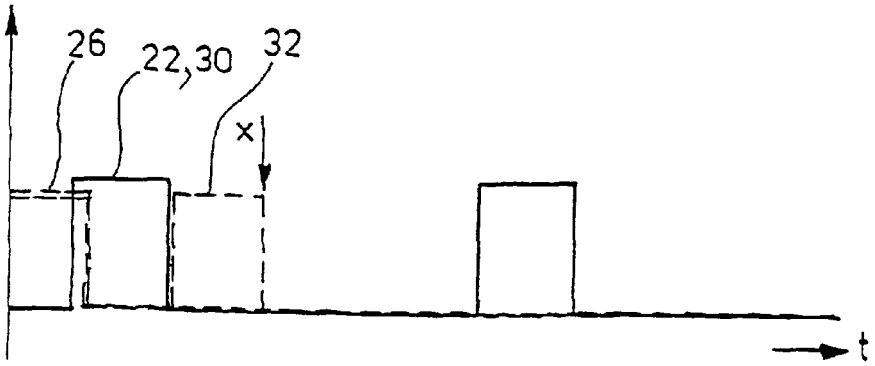

FIGS. 2A and 2C make apparent the operation of the apparatus of FIG. 1 when in proper operation and when faults occur. The pulses of the control signal 22, 30 can be seen in solid lines (with the signals in FIGS. A through C now being given the reference numbers of the lines). As was mentioned they are produced by the computer 20 and are provided to the electromagnet 18 and simultaneously pass into the control logic 28. The dotted line 32 in FIGS. 2A through 2C indicates the course of the feedback signal 32 which runs from the control logic 28 to the computer 20. The dashed line 26 indicates the sensor signal. If a control signal is produced as is shown in FIG. 2 A the pressure sensor 24 will respond at a relatively short time afterwards, producing a corresponding sensor signal 26 which comes close to the zero level in the present case. Upon termination of the control signal 22, the feedback signal 32 returns to the original level. The response time to the original level again only after a certain time lag (change-back delay $t_R$). This will be identified as a faultless condition by the control logic 28 or the computer 20.

However, if the sensor signal does not leap from the high level to the low one in the way shown in FIG. 2B when a control signal 22, 30 appears the high level of the feedback signal 32 will not change. This will be identified as a fault. No pressure surge will be produced although the valve opens.

In FIG. 2C, although a sensor signal is produced at a low level after the valve opens the output signal 26 of the sensor 24 remains at a low level upon termination of the control signal, which means that compressed air is being measured as before. This indicates that the valve 26 is not properly closed. Therefore, if a certain reset time is exceeded as is shown in FIG. 2C a fault is signalled as well.

The above Examples and disclosure are intended to be illustrative and not exhaustive. These example and description will suggest many variations and alternatives to one of the ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An apparatus for singling out tablets for a rotary tablet-compressing press which includes a rotor with a plurality of dies for pressing tablets in the dies by associated rams during rotation of the rotor, the apparatus comprising control means to control the function of the rotary press and the quality of the tablets, and rejection means which reject non-acceptable tablets, the rejection means including a nozzle which, via a line and a controllable valve disposed in the line is adapted to be connected to a pressure source in order to route a tablet into a rejection duct, the valve being operated by a control signal of the control means, a pressure sensor (24) being disposed in the line which delivers a sensor signal if the valve is opened or a pre-determined minimum pressure prevails in the line, respectively, and a logic evaluation circuit being provided into which the pressure signal and the control signal are input and which produces a feedback signal for the control means, the feedback signal being indicative of the time relation of the control signal and the sensor signal, and the control means generating an error signal if the time relation of the control signal and the sensor signal deviates from a pre-determined relation.

2. The apparatus according to claim 1, characterized in that if the sensor signal (26) is not terminated an error signal (32) will be produced only after the sensor signal (26) persists for a predetermined period of time (a change-back time) after the termination of the control signal (22, 30).

3. The apparatus according to claim 1, characterized in that an error signal (32) will be produced if the sensor signal (26) does not change when a control signal (22) is produced.

* * * * *